US008397970B2

(12) United States Patent
Iijima et al.

(10) Patent No.: US 8,397,970 B2
(45) **Date of Patent: *Mar. 19, 2013**

(54) DRIVING MACHINE

(75) Inventors: Yoshimitsu Iijima, Ibaraki (JP); Isamu Tanji, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/405,929

(22) Filed: Feb. 27, 2012

(65) Prior Publication Data

US 2012/0153004 A1 Jun. 21, 2012

Related U.S. Application Data

(63) Continuation of application No. 12/209,394, filed on Sep. 12, 2008, now Pat. No. 8,123,096.

(30) Foreign Application Priority Data

Sep. 13, 2007 (JP) ..... P2007-238020
Apr. 18, 2008 (JP) ..... P2008-109287

(51) Int. Cl.
*B25C 1/04* (2006.01)

(52) U.S. Cl. ..... 227/120; 227/8; 227/119

(58) Field of Classification Search ..... 227/8, 119, 227/120, 147
See application file for complete search history.

(56) References Cited

U.S. PATENT DOCUMENTS 3,834,602 A 9/1974 Obergfell
5,238,167 A 8/1993 Howard et al.
6,578,749 B1 * 6/2003 Shen et al. ..... 227/119
6,789,718 B2 9/2004 Canlas et al.
6,808,101 B2 * 10/2004 Laubach et al. ..... 227/109
8,123,096 B2 * 2/2012 Iijima et al. ..... 227/120
2003/0218044 A1 11/2003 Laubach et al.
2004/0050899 A1 3/2004 Canlas et al.
2006/0071047 A1 4/2006 Aguirre et al.

FOREIGN PATENT DOCUMENTS

JP 51-158473 U 12/1976
JP 2003-340746 A 12/2003
JP 2004-330366 11/2004
JP 2004-330372 11/2004
JP 2005-313290 A 11/2005

OTHER PUBLICATIONS

Japanese Office Action, and English translation thereof, issued in Japanese Patent Application No. 2008-109287 mailed Nov. 26, 2012.

* cited by examiner

*Primary Examiner* — Rinaldi Rada
*Assistant Examiner* — Nathaniel Chukwurah
(74) *Attorney, Agent, or Firm* — McDermott Will & Emery LLP

(57) ABSTRACT

The present application relates to a driving machine. The driving machine has a driver blade for striking a fastener and a nose portion having formed therein an injection passage which slidably guides the driver blade, and into which the fastener is fed to be injected therefrom. An injection hole from which the fastener is injected is specified at a leading end in an injecting direction of the injection passage. The injection hole is defined by a first guide portion and a second guide portion which is movable relative to the first guide portion so as to change a cross section, perpendicular to the injecting direction, of the injection hole. A positioning apparatus is provided to dispose the second guide portion at a plurality of positions relative to the first guide portion.

9 Claims, 6 Drawing Sheets

DRIVING MACHINE

This application is a Continuation of U.S. application Ser. No. 12/209,394 filed on Sep. 12, 2008, now U.S. Pat. No. 8,123,096, which is based upon and claims a priority from prior Japanese Patent Application No. 2007-238020 filed on Sep. 13, 2007 and from prior Japanese Patent Application No. 2008-109287 filed on Apr. 18, 2008, the entire contents of which are incorporated herein by reference.

BACKGROUND OF THE INVENTION

1. Field of the Invention

The present invention relates to a driving machine.

2. Description of the Related Art

Conventionally, a driving machine is known in which a fastener such as a nail is struck by a driver blade to drive the nail into lumber or the like. In this driving machine, the diver blade is driven by using compressed air, a fuel such as a gas, a motor, or the like as its power. In this driving machine, a fastener is supplied into an injection passage in which the driver blade slides, and the fastener in this injection passage is struck by the driver blade to drive out the fastener from an injection hole at a leading end of the injection passage.

In the driving machine which is adapted to drive out the nail in the injection hole by this driver blade, counteraction in the operation of the driver blade is produced in a main body portion of the driving machine, so that a phenomenon occurs in which the driving machine is operated in an opposite direction to the driving direction of the fastener. Due to this counteraction, torque in which a leading end portion of a nose portion forming the injection hole is moved forward is produced at the same time as the fastener is driven out from the injection hole. The nail in the injection passage can tilt due to this torque, in which case the nail is disadvantageously driven in this tilted state, resulting in faulty nailing finish. Particularly in the case of a nail having a small head diameter and a short shank length, since the angle of inclination of the nail in the injection hole becomes large, the tendency of the nail being driven in the tilted state becomes large.

To prevent this, as shown in JP-2004-330372-A, a structure is disclosed in which a guide member having an inside diameter conforming to the size of the fastener used is attached to a leading end of the nose portion, and the guide member is replaced depending on an application. In addition, as shown in JP-2004-330366-A, a structure is disclosed in which a rotatable guide member having an inclined surface defined thereon for guiding the leading end portion of the fastener to the center of the injection hole is disposed at a portion where the nose portion injection hole is formed.

With the structure in accordance with JP-2004-330372-A, the fastener can be suitably held so as to be capable of being driven in, and yet there have been problems in that the guide member is removed during the operation, and that the removed guide member can be lost. With the structure in accordance with JP-2004-330366-A, since the guide member is located on the sliding path of the driver blade, each time the fastener is driven in, the guide member is subjected to an impact force by the driver blade, so that it has been difficult to ensure the durability of the guide member.

SUMMARY OF THE INVENTION

Accordingly, an object of the invention is to provide a driving machine in which the fastener can be suitably held so as to be capable of being driven in, and in which the durability is improved.

To overcome the above-described problems, in accordance with the invention there is provided a driving machine including: a driver blade for striking a fastener; and a nose portion having formed therein an injection passage which slidably guides the driver blade, and into which the fastener is fed to be injected therefrom, wherein an injection hole from which the fastener is injected is specified at a leading end in an injecting direction of the injection passage, wherein the injection hole being defined by a first guide portion and a second guide portion which is movable relative to the first guide portion so as to change a cross section, perpendicular to the injecting direction, of the injection hole, and wherein a disposing means is provided to dispose the second guide portion at a plurality of positions relative to the first guide portion. In this driving machine, the disposing means preferably disposes the second guide portion at a position where the second guide portion does not interfere with the driver blade.

According to the above-described construction, it is possible to form the injection hole which is adapted to the size of the fastener to be driven in by changing the cross section of the injection hole. At this time, it is possible to prevent the abutment of the driver blade against the second guide portion.

In addition, preferably, a magazine incorporating a plurality of fasteners and adapted to supply the fasteners into the injection passage is connected to the nose portion, and the disposing means is constructed to reciprocatably move the second guide portion in a direction from the magazine toward the injection passage, and is constructed so as to make an area of the cross section small when the second guide portion has moved in the direction from the magazine toward the injection passage.

According to the above-described construction, the direction in which the fastener moves from the magazine into the injection passage and the moving direction of the second guide portion can be made to substantially coincide with each other. Accordingly, it is possible to make the area of the cross section small with a simple construction.

In addition, the second guide portion may be mounted rotatably about an axis which is perpendicular to the injecting direction and the direction from the magazine toward the injection passage, and the disposing means may be constructed by including a spring for rotatably urging the second guide portion so as to move the second guide portion in a direction in which the second guide portion is brought into close proximity with the first guide portion and to make the area of the cross section small and a restricting portion which abuts against the second guide portion to restrict a distance provided between the second guide portion and the first guide portion by the spring.

In addition, the second guide portion may have a held portion which extends in the direction from the magazine toward the injection passage, and the disposing means may be constructed by including a holding portion which is provided on one of the nose portion and the magazine and which is adapted to hold the held portion slidably in the direction from the magazine toward the injection passage and is capable of fixing the held portion at an arbitrary position.

According to each of the above-described constructions, it is possible to fix the second guide portion at a plurality of positions relative to the first guide portion.

According to the driving machine in accordance with the invention, the fastener can be suitably held so as to be capable of being driven in, and the durability improves.

BRIEF DESCRIPTION OF THE DRAWINGS

Embodiments of the present invention will be described in detail based on the following figures, wherein.

DETAILED DESCRIPTION OF THE INVENTION

Figure 1:
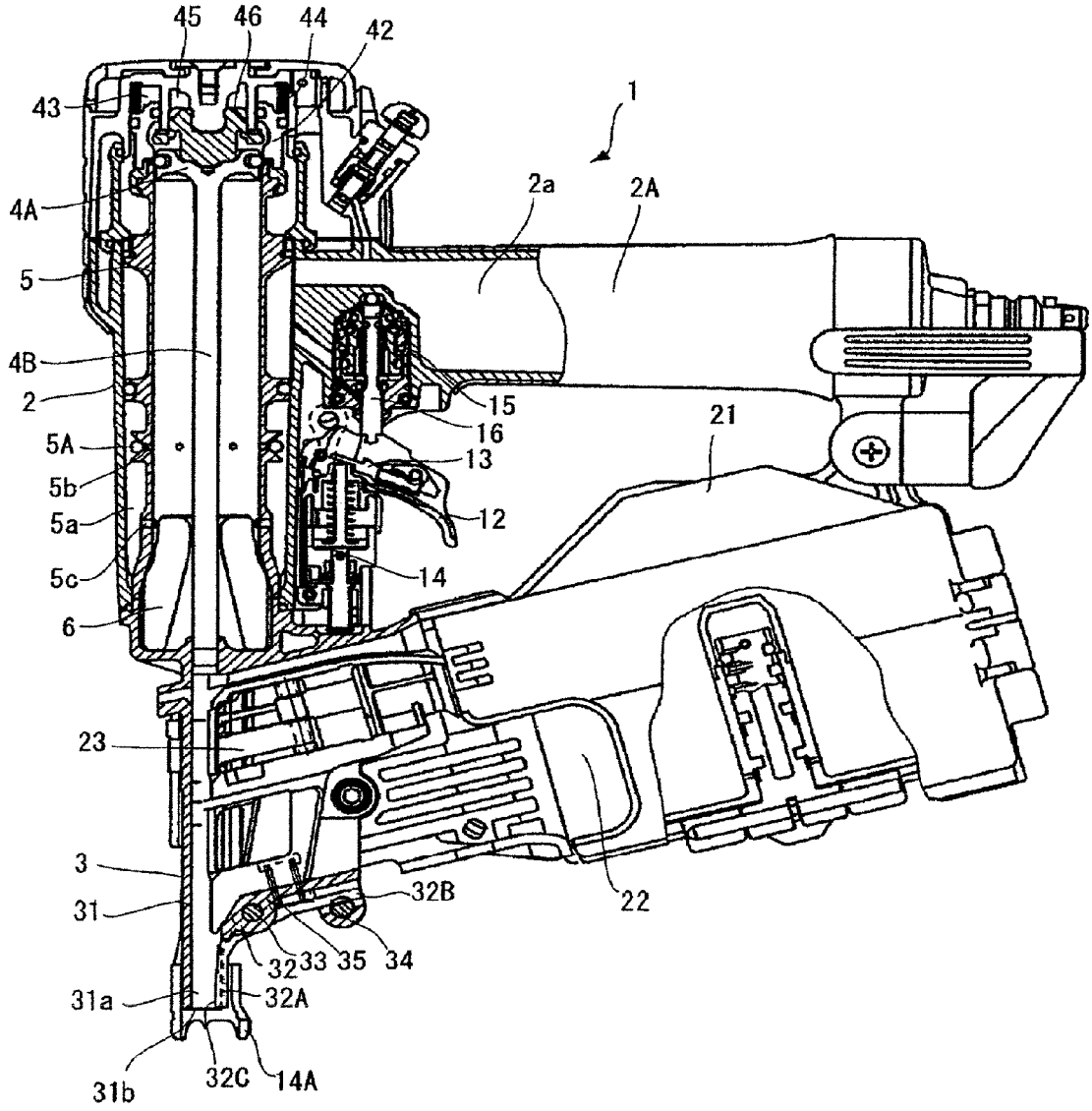
FIG. 1 is a cross-sectional view of a driving machine in accordance with a first embodiment of the invention.

Referring now to FIGS. 1 to 5, a description will be given of a driving machine in accordance with an embodiment of the invention. A nailing machine 1 which is shown in FIG. 1 and is a driving machine is a machine for driving in a nail 10 (FIGS. 2 and 4) which is a fastener and uses compressed air as its power.

In the nailing machine 1, a frame 2, a handle 2A located on one side of the frame 2, and a nose portion located on a lower end of the frame 2 are provided integrally. To accumulate compressed air from an unillustrated compressor, an accumulation chamber 2*a* is formed in the handle 2A and the frame 2 of the nailing machine 1. The accumulation chamber 2*a* is connected to the compressor through an unillustrated air hose.

A cylinder 5 having a hollow cylindrical shape is provided within the frame 2, a piston 4A is provided in the cylinder 5 so as to be vertically slidable, and a driver blade 4B is formed integrally with the piston 4A. The direction in which this driver blade 4B moves together with the piston 4A is defined as an injecting direction.

A return air chamber 5*a* for accumulating compressed air for returning the driver blade 4B to a top dead center is formed in an outer periphery of a lower end of the cylinder 5. A check valve 5A is provided in an axially central portion of the cylinder 5, and an air passage 5*b* for circulating the air in only one direction from inside the cylinder 5 to the return air chamber 5*a* outside the cylinder 5. In addition, an air passage 5*c* which is always open to the return air chamber 5*a* is formed below the cylinder 5. In addition, a piston valve 6 for absorbing surplus energy of the piston 4A after the driving in of the nail 10 is provided at a lower end of the cylinder 5.

The following are provided, among others, in a proximal portion of the handle 2A: a trigger 12 which is operated by an operator; an arm plate 13 which is rotatably fitted to the trigger 12; a push lever 14 which protrudes from a lower end of the nose portion 3, extends to a vicinity of the arm plate 13, and is movable along the nose portion 3 by being urged from the frame 2 toward the nose portion 3 side; a trigger valve portion 15 which is a changeover valve communicating with a below-described main valve 42 and adapted to supply and exhaust the compressed air; and a plunger 16 for transmitting the operation of the arm plate 13 to the trigger valve portion 15.

As is well known, when the pulling operation of the trigger 12 and the pushing operation of the push lever 14 against a nailed member are carried out, the plunger 16 of the trigger valve portion 15 is arranged to be pushed upward by a link mechanism of the arm plate 13 and the trigger 12.

The following are provided, among others, on an outer periphery of the upper side of the cylinder 5: the main valve 42; a main valve chamber 43 for accommodating the main valve 42, a main valve spring 44 for urging the main valve 42 toward a lower dead point side; and an exhaust rubber 46 which is disposed on an upper side of the cylinder 5 and shuts off an air passage 45 for exhausting the compressed air in an upper chamber of the piston 4A of the cylinder 5 by its abutment against the main valve 42. In addition, the air passage 45 communicates with the atmosphere through an unillustrated exhaust port provided in an upper portion of the frame 2.

Figure 2:
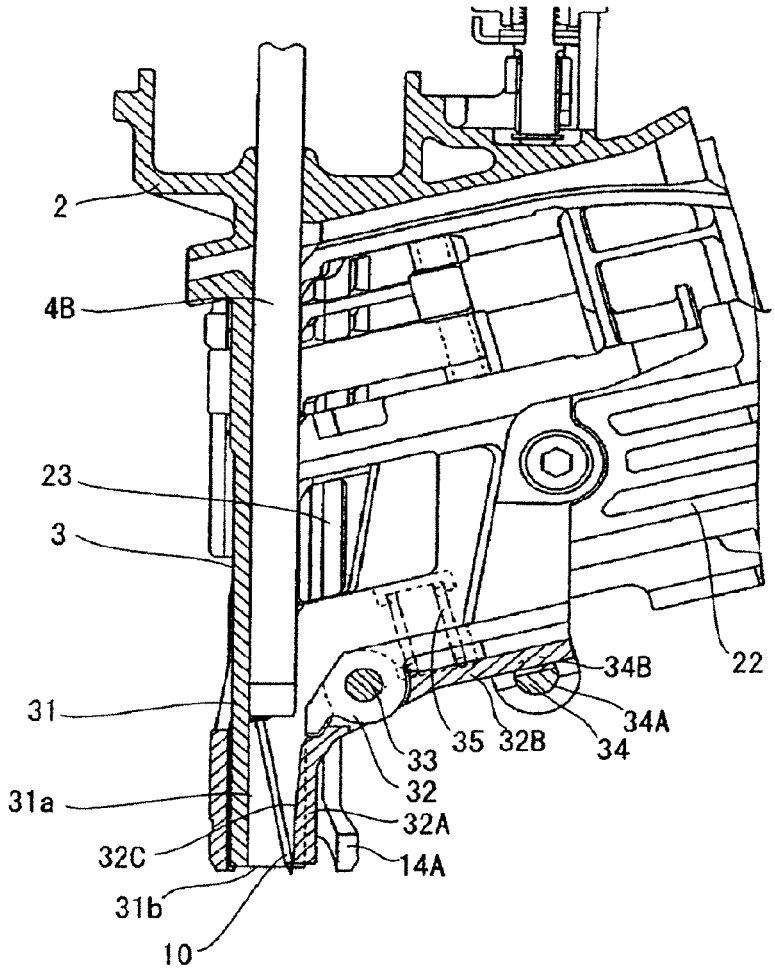
FIG. 2 is a detailed cross-sectional view of a nose portion and its vicinities when a small nail is driven in by the driving machine in accordance with the first embodiment of the invention.

As shown in FIG. 2, the nose portion 3 is constructed by including a first guide portion 31 which is located at a lower end of the frame 2 and extends in a parallel direction to the sliding direction of the driver blade 4B. A magazine unit 21 which incorporates a bundle of nails 10 which are bundled and coupled together is provided on a side (right side in FIG. 3) corresponding to an opening of a substantially U-shaped cross-sectional portion of a below-described injection passage 31*a* of the nose portion 3.

Figure 3:
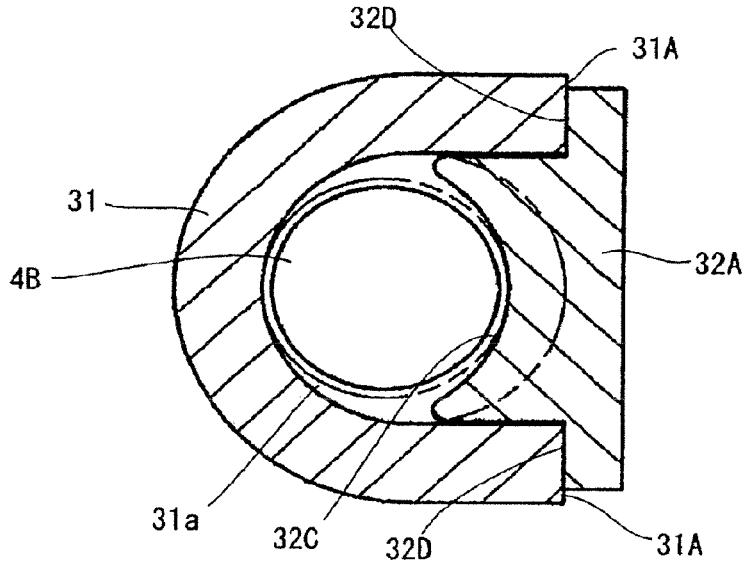
FIG. 3 is a cross-sectional view, taken in a direction perpendicular to an injecting direction, of the first guide portion and the second guide portion when the small nail is driven in by the driving machine in accordance with the first embodiment of the invention.

The first guide portion 31 is fixed to the frame 2 by an unillustrated bolt, and the injection passage 31 which serves as a portion where the driver blade 4B slides and is a portion into which the nail 10 is fed from a below-described magazine 22. As shown in FIG. 3, this injection passage 31*a* is constructed such that its cross section perpendicular to the injecting direction of the driver blade 4B is substantially U-shaped, and this substantially U-shaped opening portion is oriented from the first guide portion 31 toward the below-described magazine 22 side (FIG. 2). In addition, at a leading end position in the injecting direction of the first guide portion 31, a pair of abutting surfaces 31A, which are adapted to be abutted against a below-described second guide portion 32, are respectively specified at positions corresponding to end faces of leg portions of the substantially U-shaped portion, as shown in FIG. 3. Further, an injection hole 31*b*, through which the nail 10 is injected, is specified at a position corresponding to an endmost portion of the injection passage 31*a*, as shown in FIG. 2.

The second guide portion 32, which is pivotally supported by a rotating shaft portion 33, is provided at the leading end position of the first guide portion 31, i.e., at a portion corresponding to the opening-side position of the substantially U-shaped portion. The rotating shaft portion 33 which pivotally supports this second guide portion 32 is provided in the magazine 22, and its rotating shaft extends in a direction substantially perpendicular to the injecting direction and the direction in which the substantially U-shaped portion is open (direction oriented from the first guide portion 31 toward the below-described magazine 22).

The second guide portion 32 is constructed in a substantially L-shape by a guide portion 32A defining the injection hole 31*b* in cooperation with the first guide portion 31 as well as an abutment portion 32B abutting against a cam 34 and a spring 35 which will be described later, and is pivotally supported by the rotating shaft portion 33 at a connecting portion of this L-shape.

As shown in FIG. 3, a guide surface 32C, which defines the injection hole 31*b* (FIG. 2) and the injection passage 31*a* in cooperation with an inner surface of the first guide portion 31, is formed in the guide portion 32A. As shown in FIG. 3, the guide surface 32C in its cross section perpendicular to the injecting direction is constructed in a curved shape in the same way as the curved portion of the substantially U-shape of the first guide portion 31. In addition, a pair of surfaces 32D to be abutted against, against which the abutting surfaces 31A are abutted, are provided at a position located in close proximity to the guide surface 32C, i.e., at positions opposing the respective abutting surfaces 31A. As shown in FIG. 3, the guide surface 32C and the surfaces 32D to be abutted against are constructed such that when the abutting surfaces 31A are abutted against the surfaces 32D to be abutted against, the injection hole 31*b* defined by the guide surface 32C and the inner peripheral surface of the first guide portion 31 does not interfere with the driver blade 43. By virtue of this construction, when the driver blade 4B is driven, the driver blade 4B and the second guide portion 32 are prevented from abutting against each other, thereby making it possible to increase the durability of the nailing machine 1.

The abutment portion 32B is urged downward by the spring 35. Accordingly, the second guide portion 32 is urged clockwise in the plane of the drawing in FIG. 2, i.e., such that the guide surface 32C enters the substantially U-shaped interior of the first guide portion 31, and the abutting surfaces 31A abut against the surfaces 32D to be abutted against. In addition, the cam 34 is provided at a position opposite to the spring 35 with the abutment portion 32B located therebetween. The cam 34 is constructed such that its outer periphery is formed in a semicircular shape by a circular arc-shaped cam surface 34A and a planar cutoff surface 34B, and the cam 34 abuts against an opposite surface of the abutment portion 32B to its surface against which the spring 35 abuts. Since the distance from the rotating shaft portion 33 to the cam 34 is greater than the distance from the rotating shaft portion 33 to the spring 35, the spring 35 can be easily compressed on the basis of the principle of the lever by rotating the cam 34 to move the abutment portion 32B upward. In addition, the distance from the rotating shaft portion 33 to the guide portion 32A is substantially equal to the distance from the rotating shaft portion 33 to the spring 35. A disposing means for disposing the second guide portion 32 at a plurality of positions with respect to the first guide portion 31 is formed by the cam 34, the spring 35, and the abutting surfaces 31A.

Figure 4:
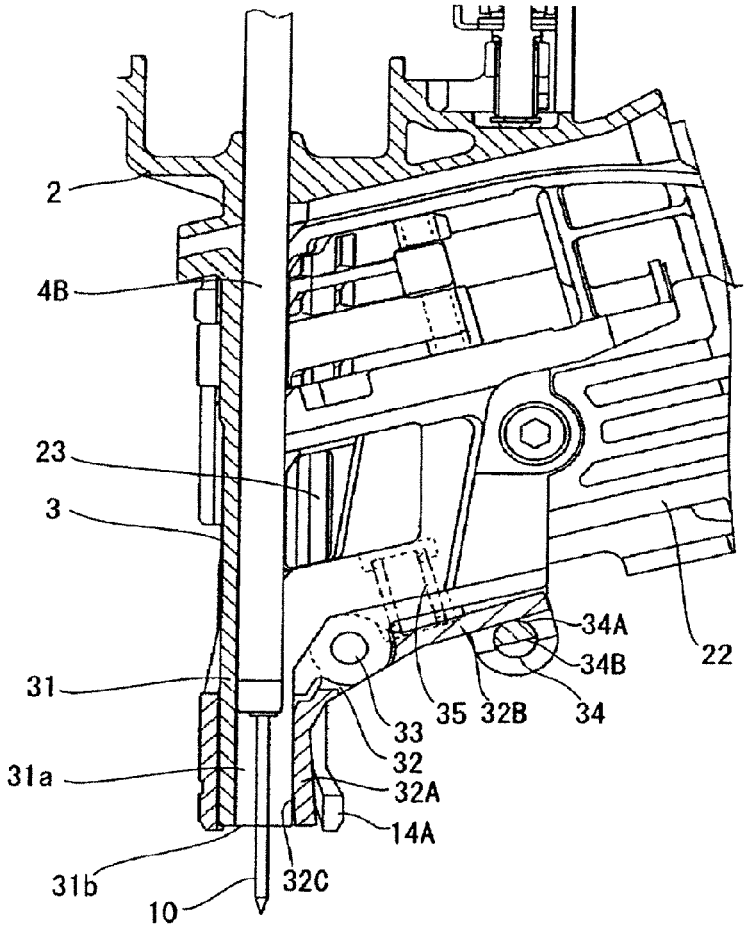
FIG. 4 is a detailed cross-sectional view of the nose portion and its vicinities when a large nail is driven in by the driving machine in accordance with the first embodiment of the invention.

As the cam 34 is rotated from the state shown in FIG. 2, the cam surface 34A abuts against the abutment portion 32B, so that the abutment portion 32B moves counterclockwise in the plane of the drawing against the urging force of the spring 35, as shown in FIG. 4. In conjunction with this movement of the abutment portion 32B, the guide portion 32A moves so as to be spaced apart from the first guide portion 31, and the area of the cross section of the injection hole 31*b* becomes large. In addition, a contact member 14A, which is formed continuously from the push lever 14 and is capable of abutting against the nailed member, is provided at a leading end in the injecting direction of the nose portion 3, i.e., at a peripheral position of the first guide portion 31 and the guide portion 32A.

The magazine unit 21 is provided with the magazine for loading the nails 10 therein and a nail feeder 23 for consecutively feeding into the injection passage 31*a* the nails 10 loaded in the magazine 22. According to such a construction, the direction in which the nail 10 moves from the magazine 22 into the injection passage 31*a* and the direction of movement of the guide portion 32A in the second guide portion 32 can be made to substantially coincide with each other. Hence, it is possible to change the area of the injection hole 31*b* by a simple construction.

In the case where the nail 10 is struck by the nailing machine 1 having the above-described construction, counteraction in the operation of the driver blade 43 is produced in the nailing machine 1, so that a phenomenon occurs in which the nailing machine 1 is operated in an opposite direction to the injection direction. Due to this counteraction, torque in which the leading end portion of the nose portion 3 is moved forward (in the direction oriented from the magazine unit 21 toward the nose portion 3) is produced at the same time as the nail 10 is driven out from the injection hole 31*b*. The head of the nail 10 can tilt due to this torque, coupled with the forward movement of the leading end portion of the nose portion 3. Accordingly, in the case where the nail 10 is a small nail, the cam 34 is rotates to a position at which the cutoff surface 34B opposes the abutment portion 32B to set the cam surface 34A in a state of non-abutment with the abutment portion 32B, as shown in FIG. 2, and the abutting surfaces 31A are abutted against the surfaces 32D to be abutted against, as shown in FIG. 3, to thereby bring the guide surface 32C into close vicinity of the inner surface of the first guide portion 31 and reduce the cross-sectional area of the injection hole 31*b*. By adopting such a shape, it is possible to reduce the angle of inclination of the nail 10 in the vicinity of the leading end of the injection passage 31*a* at the time of driving in the nail 10 having a small head and a short shank length, so that the nail 10 is prevented from being driven in with its head tilted forward, thereby making it possible to prevent faulty finish.

Figure 5:
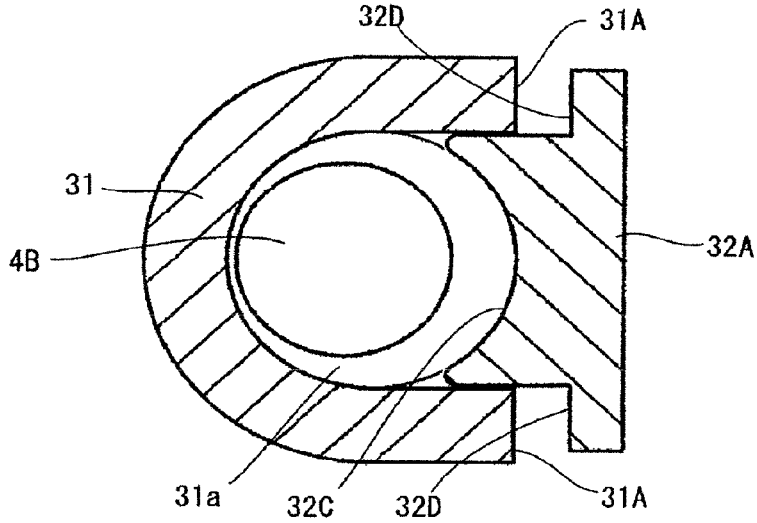
FIG. 5 is a cross-sectional view, taken in the direction perpendicular to the injecting direction, of the first guide portion and the second guide portion when the large nail is driven in by the driving machine in accordance with the first embodiment of the invention.
Figure 6A:
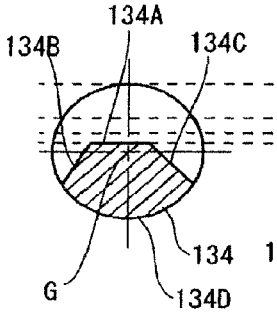
FIGS. 6A to 6D are diagrams in accordance with a modification of a cam of the driving machine in accordance with the first embodiment of the invention.
Figure 6B:
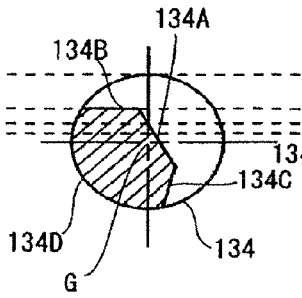
Figure 6C:
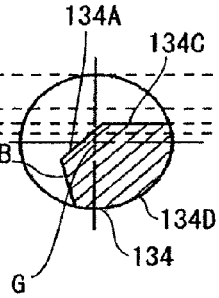
Figure 6D:
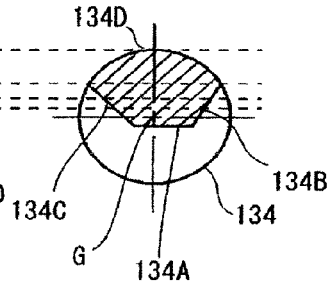

On the other hand, in a case where a large nail 10 is driven in, if the cross-sectional area of the injection hole 31*b* remains small, the nail head can strike against the guide surface 32C during the injection of the nail 10, possibly causing damage to the surface of the guide surface 32C. If damage is caused to the guide surface 32C, when the nail 10 is guided to the injection hole 21*b* by being slid on the guide surface 32C, the leading end portion of the nail 10 can possibly be caught at the damaged portion of the guide surface 32C. Accordingly, as shown in FIG. 4, the cam 34 is operated to rotate so that the cam surface 34A abuts against the abutment portion 32B to move the abutment portion 32B against the urging force of the spring 35, thereby enlarging the cross-sectional area of the injection passage 31*a* and widening the injection hole 31*b*, as shown in FIG. 5. In this state, the center (the center of the driver blade 4B in FIG. 5) of the cross section of the driver blade 4B perpendicular to its sliding direction is set in a state of being offset from the center of the widened injection hole 31*b*. Consequently, in a case where a large nail 10 is used, the occurrence of damage due to the abutment of the nail head against the guide surface 32C is suppressed, thereby making it possible to maintain a stable supply of nails.

In the first embodiment, in the cam 34, the position of the guide portion 32A of the second guide portion 32 is specified to two locations including a position located in close proximity to the first guide portion 31 and a position spaced apart therefrom. However, the invention is not limited to the same, and the position of the guide portion 32A of the second guide portion 32 may be specified to a plurality of locations by using a cam 134 such as the one shown in FIG. 6A. Specifically, the cam 134 is provided with, in addition to a cam surface 134D, a first cutoff surface 134A, a second cutoff surface 134B, and a third cutoff surface 1340 which are three surfaces whose distances from a center axis G of rotation are different. As shown in FIGS. 6A to 6D, the position of the guide portion 32A can be restricted to four locations by changing over the top face (the portion abutting against the abutment portion 32B) served by each of these three surfaces 134A to 134C and the cam surface 134D.

Figure 7A:
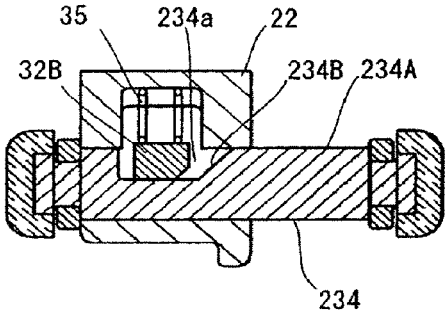
FIGS. 7A and 7B are diagrams in accordance with a first modification using a change lever instead of the cam of the driving machine in accordance with the first embodiment of the invention.
Figure 7B:
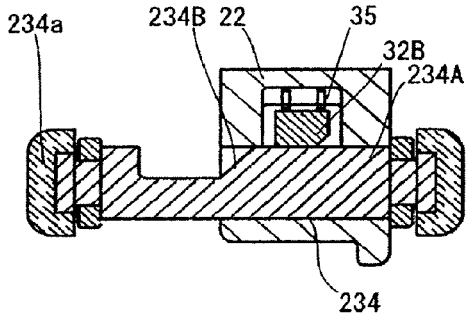

In addition, as shown in FIGS. 7A and 7B, the positional specification of the abutment portion 32B may be effected by using a change lever 234 instead of the cam. Specifically, in the magazine 22, a pin 234A is disposed at a position located in close proximity to the abutment portion 32B, the pin 234A being movable in a direction substantially perpendicular to each of the injecting direction and the direction in which the substantially U-shaped portion is open (direction oriented from the first guide portion 31 toward the below-described magazine 22). A notch 234*a* is formed in an outer peripheral portion of the pin 234A, and an inclined surface 234B continuing from the outer periphery of the pin 234A is provided on the inner surface of the notch 234*a*.

When the notch 234*a* of the change lever 234 is located at an engaging position (FIG. 7A), the abutment portion 32B enters the notch 234*a* by being urged by the spring 35, and in this state the guide portion 32A is in close proximity to the first guide portion 31. If the change lever 234 is moved from this state, the inclined surface 234B abuts against an inclined surface formed at a corner of the abutment portion 32B, and the abutment portion 32B moves from inside the notch 234*a* to an outer peripheral portion of the pin 234A in opposition to the urging force of the spring 35 (FIG. 7B). In this state, the guide portion 32A is in a state of being spaced apart from the first guide portion 31.

Figure 8A:
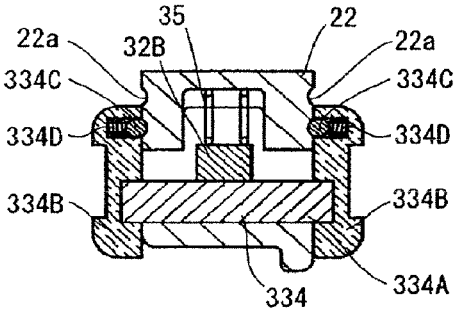
FIGS. 8A and 8B are diagrams in accordance with a second modification using a change lever instead of the cam of the driving machine in accordance with the first embodiment of the invention.
Figure 8B:
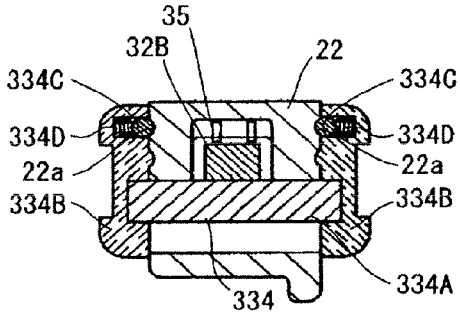

In addition, as shown in FIGS. 8A and 8B, it is possible to adopt a construction in which a change lever 334 is adapted to slide in the urging direction of the spring 35. This change lever 334 consists of a pin 334A abutting against the abutment portion 32B as well as a pair of arm portions 334B respectively provided at both end portions of the pin 334A and grasping portions of the magazine 22. A ball 334C which is urged toward the magazine 22 and a spring 334D for urging the ball 334C are provided in this arm portion 334B. The arrangement provided is such that as this ball 334C is fitted in one of a plurality of recessed portions 22*a* formed in the magazine 22, the position of the abutment portion 32B can be restricted.

Although in the first embodiment the shape of the injection passage is changed by rotating the second guide portion, the invention is not limited to the same. For example, it is possible to adopt a construction in which the second guide portion is moved so as to be brought into close proximity with or to be spaced apart from the first guide portion. Specifically, the second guide portion is provided with a held portion which extends in the direction from the magazine toward the injection passage. Meanwhile, the nose portion or the magazine is provided with a holding portion which is adapted to hold the held portion slidably in the direction from the magazine toward the injection passage and is capable of fixing the held portion at an arbitrary position. By adopting such a construction, the second guide portion becomes capable of moving in the direction from the magazine toward the injection passage, so that the second guide member can be brought into close proximity with or spaced apart from the first guide portion and can be fixed at a predetermined position.

Figure 9:
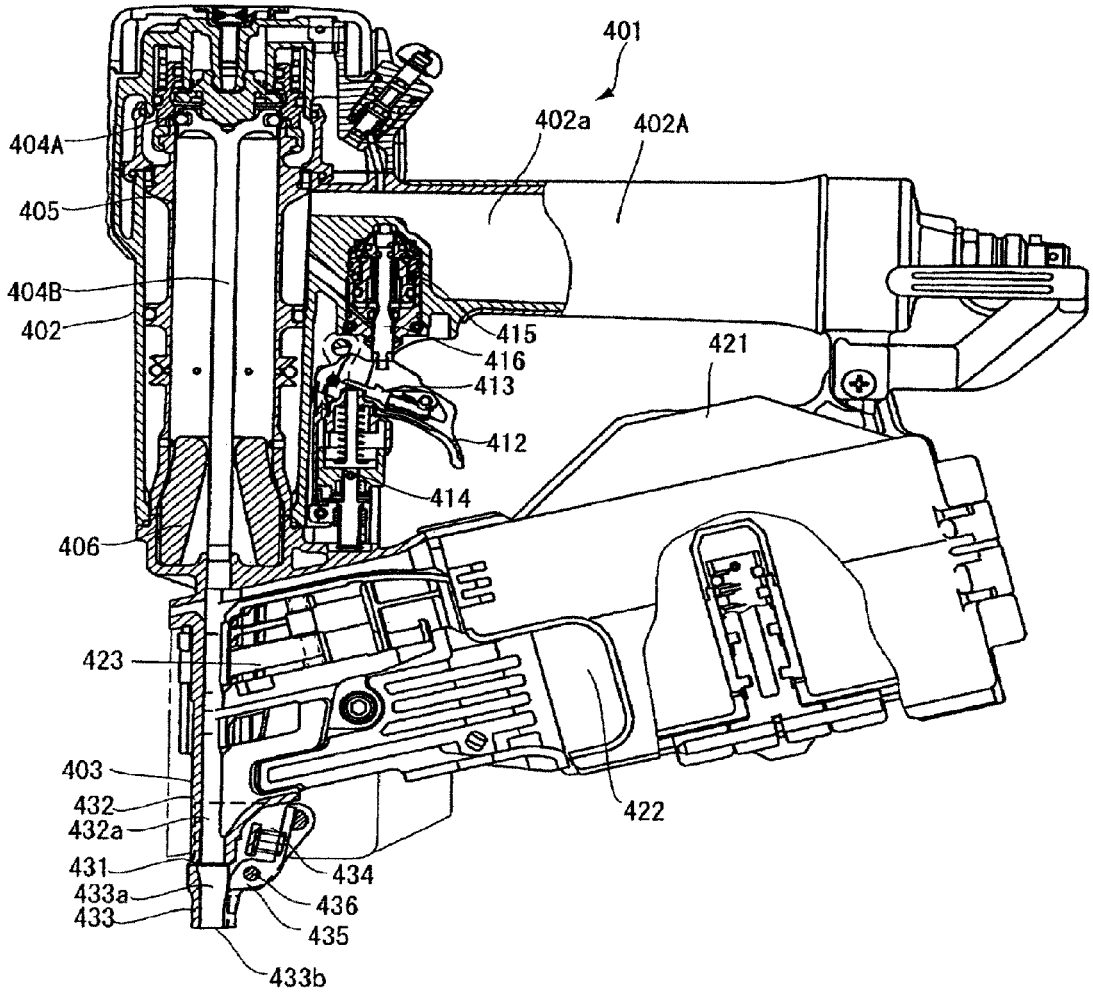
FIG. 9 is a cross-sectional view of the driving machine in accordance with a second embodiment of the invention.
Figure 10:
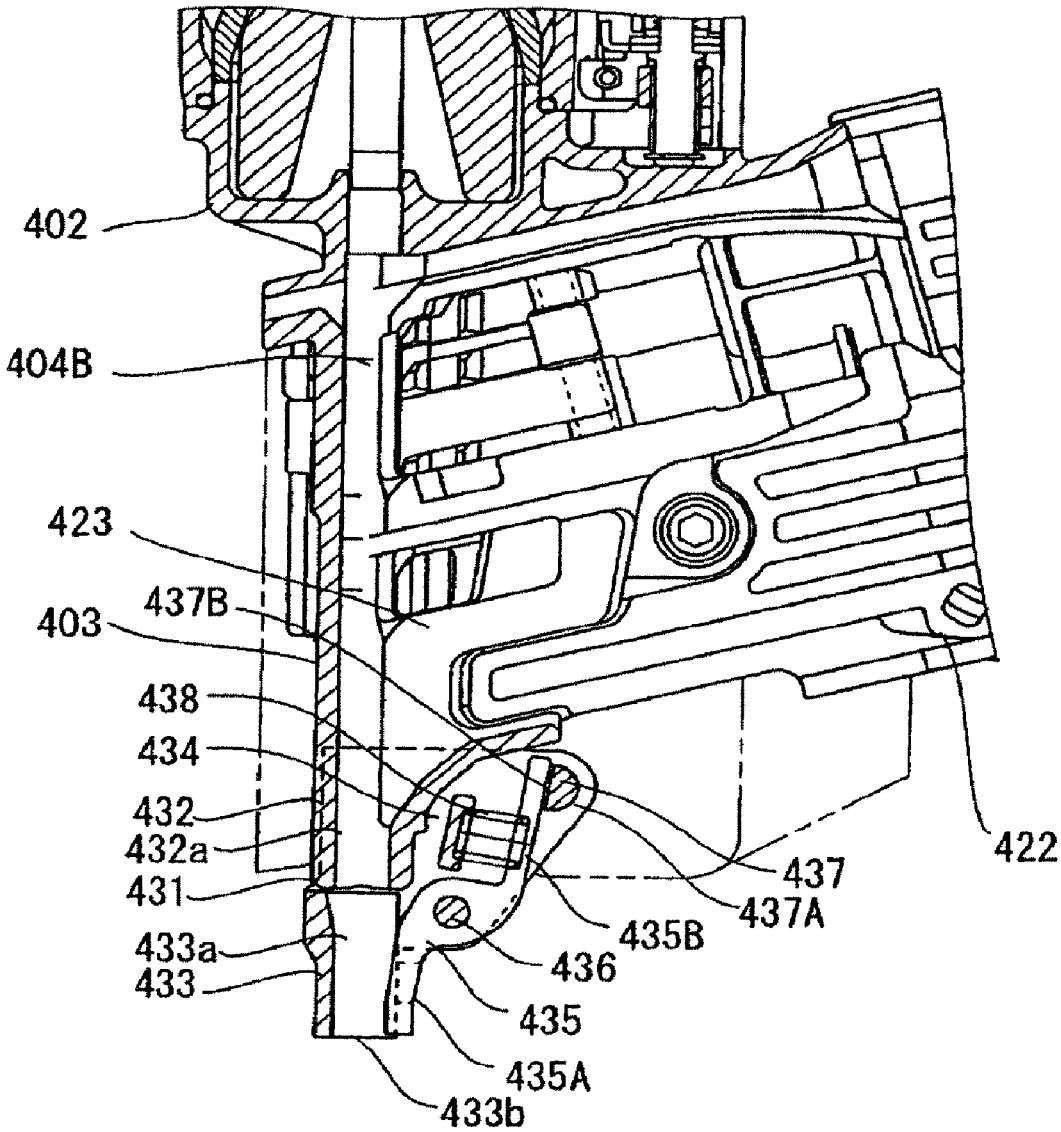
FIG. 10 is a detailed cross-sectional view of the nose portion and its vicinities of the driving machine in accordance with the second embodiment of the invention.

Next, referring to FIGS. 9 and 10, a description will be given of the driving machine in accordance with a second embodiment of the invention. A nailing machine 401 shown in FIG. 10 is constructed in substantially the same way as the nailing machine 1 of the first embodiment except for a nose portion 403. Therefore, as for the construction except for the nose portion 403, 400 will be added to the reference numerals of the nailing machine 1, and a description thereof will be omitted.

The nose portion 403 is constructed by including a first guide portion 431 which is located at a lower end of a frame 402 and extends in a parallel direction to the sliding direction of a driver blade 404B. The first guide portion 431 is constructed by including a main trunk portion 432 and an auxiliary trunk portion 433.

The main trunk portion 432 is fixed to the frame 402 by an unillustrated bolt, and a main injection passage 432*a*, which is a portion where the driver blade 404B slides and a portion to which the nails are fed from a magazine 422, is formed therein. In the same way as the injection passage 31 of the first embodiment, this main injection passage 432*a* is formed at the position where its cross section perpendicular to the injecting direction of the driver blade 404B is substantially U-shaped.

The auxiliary trunk portion 433 is disposed on the leading end side of the main trunk portion 432, i.e., at a distal endmost position of the nailing machine 401, and is constructed to be movable in a parallel direction to the sliding direction of the driver blade 404B with respect to the main trunk portion 432. Further, the auxiliary trunk portion 433 is connected to a push lever 414. Accordingly, as the auxiliary trunk portion 433 is moved (moved upward in the plane of the drawing of FIG. 9) so as to be brought into close proximity with the main trunk portion 432, the push lever 414 is pushed upward, so that a plunger 416 can be operated on the basis of the operation of this push lever 414.

The auxiliary trunk portion 433 is constructed with a substantially U-shaped cross section in the same way as the main trunk portion 432, and an auxiliary injection passage 433*a* communicating with the main injection passage 432*a* is formed at this substantially U-shaped portion. An injection hole 433*b* from which the nail is injected is specified at the position corresponding to the endmost portion of the auxiliary injection passage 433*a*. Accordingly, the nail fed into the main injection passage 432*a* is struck by the driver blade 404B, passes through the main injection passage 432*a* and the auxiliary injection passage 433*a*, and is injected from the injection hole 433*b*. As for the portion of the auxiliary trunk portion 433 in proximity to the injection hole 433*b*, a structure is adopted which is substantially equivalent to the structure (structure of the abutting surfaces 31A and the like) in proximity to the injection hole 31*a* of the first guide portion 31 in the first embodiment.

The endmost portion which defines the injection hole 433*b* in the auxiliary trunk portion 433 serves as the portion which abuts against a nailed member. Accordingly, as the nailing machine 401 is pressed by applying the endmost portion of the auxiliary trunk portion 433 to the nailed member, the plunger 416 is pushed upward, making it possible to effect nailing. Since the leading end portion of the auxiliary trunk portion 433 only defines the injection hole 433*b*, the leading end portion of the auxiliary trunk portion 433 is constructed more slenderly than the leading end portion of the nailing machine 1 in accordance with the first embodiment. Hence, as compared with the nailing machine 1 in accordance with the first embodiment, the leading end of the nailing machine 401 can be suitably applied even to a narrower portion of the nailed member, so that the operation can be suitably performed.

In addition, the auxiliary trunk portion 433 is provided with a plate 434 which extends in a direction from the auxiliary trunk portion 433 toward the main trunk portion 432 and in a direction from the auxiliary trunk portion 433 toward the magazine 22 and is disposed in parallel to the injecting direction. A second guide portion 435, which is pivotally supported by a rotating shaft portion 436, is provided at a portion corresponding to the opening-side position of the substantially U-shaped portion of the plate 434. The rotational axis of the rotating shaft portion 436 which pivotally supports this second guide portion 435 extends in a direction which is substantially perpendicular to each of the injecting direction and the direction in which the substantially U-shaped portion is open.

The second guide portion 435 is constructed by a guide portion 435A defining the injection hole 433*b* in cooperation with the auxiliary trunk portion 433 as well as an abutment portion 435B abutting against a cam 437 and a spring 438 which will be described later, and is pivotally supported by the rotating shaft portion 436 at its substantially intermediate portion between the guide portion 435A and the abutment portion 435B.

In the guide portion 435A, a construction (the guide surface 32C, the surfaces 32D to be abutted against, etc.) which is similar to that of the guide portion 32A of the first embodiment is adopted. Accordingly, the construction provided is such that the injection hole 433*b* defined by the second guide portion 435 and the auxiliary trunk portion 433 does not interfere with the driver blade 404B. By virtue of this construction, when the driver blade 404B is driven, the driver blade 404B and the second guide portion 435 are prevented from abutting against each other, thereby making it possible to increase the durability of the nailing machine 401.

As the abutment portion 435B is urged by the spring 438, the second guide portion 435 is urged clockwise in the plane of the drawing in the same way as the second guide portion 32 of the first embodiment. In addition, the cam 437 is provided at a position opposite to the spring 438 with the abutment portion 435B located therebetween. The cam 437 is provided with a cam surface 437A and a planar cutoff surface 437B, and a construction equivalent to that of the cam 34 in accordance with the first embodiment is adopted. Accordingly, by rotating the cam 437, the spring 438 can be easily compressed to rotate the second guide portion 435 counterclockwise, such that the guide portion 435A moves so as to be spaced apart from the auxiliary trunk portion 433, thereby making it possible to enlarge the area of the cross section of the injection hole 433*b*. Hence, in the same way as the nailing machine 1 in accordance with the invention, the size of the injection hole 433*b* can be changed in correspondence with the size of the nail to be driven in, thereby making it possible to maintain a stable supply of nails.

It should be noted that it goes without saying that, also in the above-described nailing machine 401 in accordance with the second embodiment, it is possible to adopt modifications of the cam which are similar to those of the first embodiment.

The driving machine in accordance with the invention is not limited to the foregoing embodiments, and various modifications and changes are possible within the range defined by the claims of the invention. For example, although in the above-described embodiments reference have been given to the pneumatic nailing machine, the invention is also applicable to such as a combustion-type driving machine using fuel and an electrically operated driving machine using a motor or the like.

What is claimed is:

1. A driving machine comprising:

a driver blade for striking a fastener; and a nose portion having an injection passage for the fastener to be injected, wherein the nose portion comprises:

a first guide member extending in an injecting direction of the fastener, a cross section of the first guide member perpendicular to the injecting direction being substantially U-shaped and having a semicircular portion and linear portions extending in a direction perpendicular to the injection direction, the linear portions extending parallel with each other; and a second guide member having an arcuate surface which is faced with the semicircular portion of the first guide member and flat surfaces which are faced with the linear portions of the first guide member, wherein:

the second guide member is pivotally supported by a shaft, the second guide member can move to a first position at which a cross section of the injection passage perpendicular to the injecting direction is relatively large and to a second position at which the cross section of the injection passage is relatively small when the second guide member is abutting with a portion of the first guide member, and member to the second position, and the linear portions of the first guide member and the flat surfaces of the second guide member confront to each other in both cases where the second guide member is at the first position and at the second position.

2. The driving machine according to claim 1, wherein the first guide member has an outer peripheral surface, an inner peripheral surface and an end surface, the second guide member has a surface abatable against the end surface of the first guide member, and the end surface is the portion of the first guide member to be abutted with by the second guide member.

3. The driving machine according to claim 1, further comprising:

a positioning means for moving the second guide member in the direction perpendicular to the injection direction and selectively fixing the second guide member at one of the first position and the second position.

4. The driving machine according to claim 1, wherein the nose portion includes a spring configured to bias the second guide member toward the second position.

5. A driving machine comprising:

a driver blade for striking a fastener; and a nose portion having an injection passage for the fastener to be injected, wherein the nose portion comprises:

a first guide member extending in an injecting direction of the fastener, a cross section of the first guide member perpendicular to the injecting direction being substantially U-shaped and having a semicircular portion and linear portions extending in a direction perpendicular to the injection direction, the linear portions extending parallel with each other; and a second guide member having an arcuate surface which is faced with the semicircular portion of the first guide member and flat surfaces which are faced with the linear portions of the first guide member, wherein:

the second guide member is pivotally supported by a shaft, the second guide member can move to a first position at which a cross section of the injection passage perpendicular to the injecting direction is relatively large and to a second position at which the cross section of the injection passage is relatively small when the second guide member is abutting with a portion of the first guide member, the second guide member is inclined with respect to the first guide member when the second guide member is at the second position so that a cross section of an upper portion of the injection passage perpendicular to the injection direction is relatively larger than that of a lower portion of the injection passage, and the linear portions of the first guide member and the flat surfaces of the second guide member confront to each other at least when the second guide member is at the second position.

6. The driving machine according to claim 5, wherein:

the first guide member has an outer peripheral surface, an inner peripheral surface and an end surface, the second guide member has a surface abatable against the end surface of the first guide member, and the end surface is the portion of the first guide member to be abutted with by the second guide member.

7. The driving machine according to claim 5, wherein the nose portion includes a spring configured to bias the second guide member toward the second position.

8. The driving machine according to claim 5, further comprising:

a positioning means for moving the second guide member in the direction perpendicular to the injection direction and selectively fixing the second guide member at one of the first position and the second position.

9. The driving machine according to claim 5, wherein the linear portions of the first guide member and the flat surfaces of the second guide member are faced with each other in both cases that the second guide member is at the first position and at the second position.

* * * * *